US005527154A

United States Patent [19]

Drajan

[11] Patent Number: 5,527,154

[45] Date of Patent: Jun. 18, 1996

[54] VARIABLE PITCH BOAT PROP

[76] Inventor: Cornell Drajan, 1086 Spartanburg Hwy., Hendersonville, N.C. 28792

[21] Appl. No.: 359,527

[22] Filed: Dec. 20, 1994

[51] Int. Cl.[6] ..... B63H 3/04

[52] U.S. Cl. ..... 416/166; 416/164; 416/153

[58] Field of Search ..... 416/164, 166, 416/134 R, 147, 153

[56] References Cited

U.S. PATENT DOCUMENTS

| | | | |
|---|---|---|---|
| 524,500 | 8/1894 | Hindes . | |
| 1,980,248 | 11/1934 | Bates . | |
| 1,982,170 | 11/1934 | Lansing . | |
| 3,095,932 | 7/1963 | Hercules | 416/166 |
| 3,295,610 | 1/1967 | Frias . | |
| 3,310,118 | 3/1967 | Smith | 416/166 |
| 3,331,446 | 7/1967 | Feroy | 416/164 |
| 4,792,279 | 12/1988 | Bergeron . | |
| 4,929,153 | 5/1990 | Speer . | |
| 5,022,820 | 6/1991 | Bergeron . | |
| 5,032,057 | 7/1991 | Speer . | |
| 5,145,318 | 9/1992 | Olson | 416/164 |

FOREIGN PATENT DOCUMENTS

| | | | |
|---|---|---|---|
| 1922834 | 11/1970 | Germany | 416/166 |
| 0539831 | 9/1941 | United Kingdom | 416/166 |
| 0684421 | 12/1952 | United Kingdom | 416/166 |
| 2063805 | 6/1981 | United Kingdom | 416/134 R |

*Primary Examiner*—Edward K. Look
*Assistant Examiner*—Mark Sgantzos
*Attorney, Agent, or Firm*—Shoemaker and Mattare, Ltd.

[57] ABSTRACT

A variable pitch boat prop includes a hub fixed to the prop shaft, a sleeve surrounding the hub and having bearings which receive stub shafts from a plurality of blades. The stub shafts pivot in the bearings, so that the blade pitch can change. Pinion teeth formed on the stub shafts mate with respective toothed racks fixed to the hub and disposed at an acute angle to the hub axis. The center of pressure of each blade is offset downstream from the stub shaft axis, so that dynamic pressure on the blades tends to decrease blade pitch, while the rack and pinion tend to increase blade pitch. These opposing moments are at equilibrium at different blade pitches, according to the speed of the boat and the prop shaft torque. Blade pitch increases automatically as speed increases, and decreases at load increases.

9 Claims, 4 Drawing Sheets

VARIABLE PITCH BOAT PROP

BACKGROUND OF THE INVENTION

This invention relates generally to marine propulsion and more particularly to a variable pitch boat prop.

The effective angle of attack of a fixed-pitch prop changes as a function of boat speed. A fixed pitch prop is generally a monolithic body comprising a hub, affixed to a driveshaft powered by the motor, and two or more blades arranged around the hub at equal intervals. One has to choose, in selecting prop pitch, between low speed acceleration and top speed. Higher pitch props (up to a limit) produce higher top speeds from a given motor, but poorer acceleration. One generally has to compromise, selecting a prop pitch for best all-round performance: this is a somewhat subjective or empirical exercise. For a given boat, the best pitch may vary from site to site, so some boaters keep an assortment of props, to be ready for various situations.

It has long been recognized that making prop pitch variable can enable one, at least in theory, to optimize pitch for varying conditions. In practice, the pitch may be adjustable in the range of about 15° to 30°. Prop "pitch" is defined as the angle that a chord of the prop makes with a plane perpendicular to the axis of the prop. The term has an entirely different meaning when used in describing gear teeth.

In discussing prop geometry, it is most convenient to use a cylindrical coordinate system. The direction of the drive shaft is "longitudinal", any perpendicular to the shaft axis has a "radial" direction, and the direction perpendicular to radial, and in a plane perpendicular to the prop axis, is "tangential". For helical threads and the like, the "helix angle" is defined as the angle a tangent to the thread makes with respect to an intersecting radial plane. Prop "pitch", as used herein, means the helix angle of a chord of the prop, a chord being a line extending from the leading edge of the prop to the trailing edge.

Some prior variable pitch props had mechanical means, such as cams, for changing the blade angle. Others used resilient biasing of some type, and some had centrifugal actuation.

SUMMARY OF THE INVENTION

The present invention avoids all of these approaches, and provides instead a very simple mechanism in which blade pitch is controlled by balancing forces which are functions of prop torque, thrust, and speed.

Each blade of a prop has a center of pressure. It is a routine matter to determine location of the center of pressure for a given blade. In this invention, each blade is supported on a hub by a stub shaft which extends in a radial direction through a bearing on the hub. The axis of the stub shaft is approximately coplanar with the working surface of the blade, and offset upstream from the center of pressure so that increasing dynamic pressure on the blade tends to decrease blade pitch. The consequent pitch reduction normally reduces the dynamic pressure.

Each stub shaft is provided with a pinion, which is maintained in constant mesh with a rack-like gear segment (referred to hereafter simply as a "rack") formed as part of, or affixed to the hub. The racks extend oblique to the longitudinal direction, and therefore as shaft torque increases the pinions have an increasing tendency to roll "down" the racks, that is, away from the boat, decreasing blade pitch angle.

The forces tending to reduce blade angle are countered by the thrust on the blade, which tends to push the blades forward with respect to the hub, urging the pinions to roll "up" their racks, increasing the blade angle.

I have found that by choosing the proper offset distance (from the stub shaft axis to the center of pressure), pinion diameter, and rack angle, one can balance the above forces. When these parameters are properly selected, the blade angle changes automatically to provide substantially a constant-speed prop, irrespective of boat speed. This characteristic is very important for obtaining good fuel economy, particularly with a two-stroke engine having a narrow power band.

An object of the invention is to automatically adjust prop pitch in response to changes in boat speed and engine torque, so as to maintain proper pitch angle at all times.

Another object of the invention is to adjust prop pitch automatically so as to maintain engine speed within a narrow range despite varying conditions, thus to improve fuel economy.

A further object of the invention is to simplify the design of variable-pitch props, thereby making such props affordable and even cost-attractive in comparison with fixed props.

These and other objects are attained by a variable pitch boat prop comprising a hub to be installed on the prop shaft of a boat, a plurality of prop blades disposed around the hub, means for supporting each blade, while permitting the blade to pivot, and means for automatically controlling the angularity of each blade, in response to engine torque, engine speed and prop thrust. The controlling means includes a stub shaft affixed to each blade, a pinion formed on the stub shaft, and a rack affixed to the hub and engaging the pinion. The blade supporting means is preferably a sleeve surrounding the hub, having a number of radially extending bearings or bushings, each for receiving one of the stub shafts. The sleeve moves longitudinally with respect to the hub as prop pitch changes. The center of pressure of each blade is offset downstream from the stub shaft axis, so that increasing pressure tends to reduce blade pitch. The offset distance is optimized to achieve proper blade pitch throughout the operating range, at a substantially constant engine speed.

BRIEF DESCRIPTION OF THE DRAWINGS

In the accompanying drawings.

DESCRIPTION OF THE PREFERRED EMBODIMENT

Figure 1:
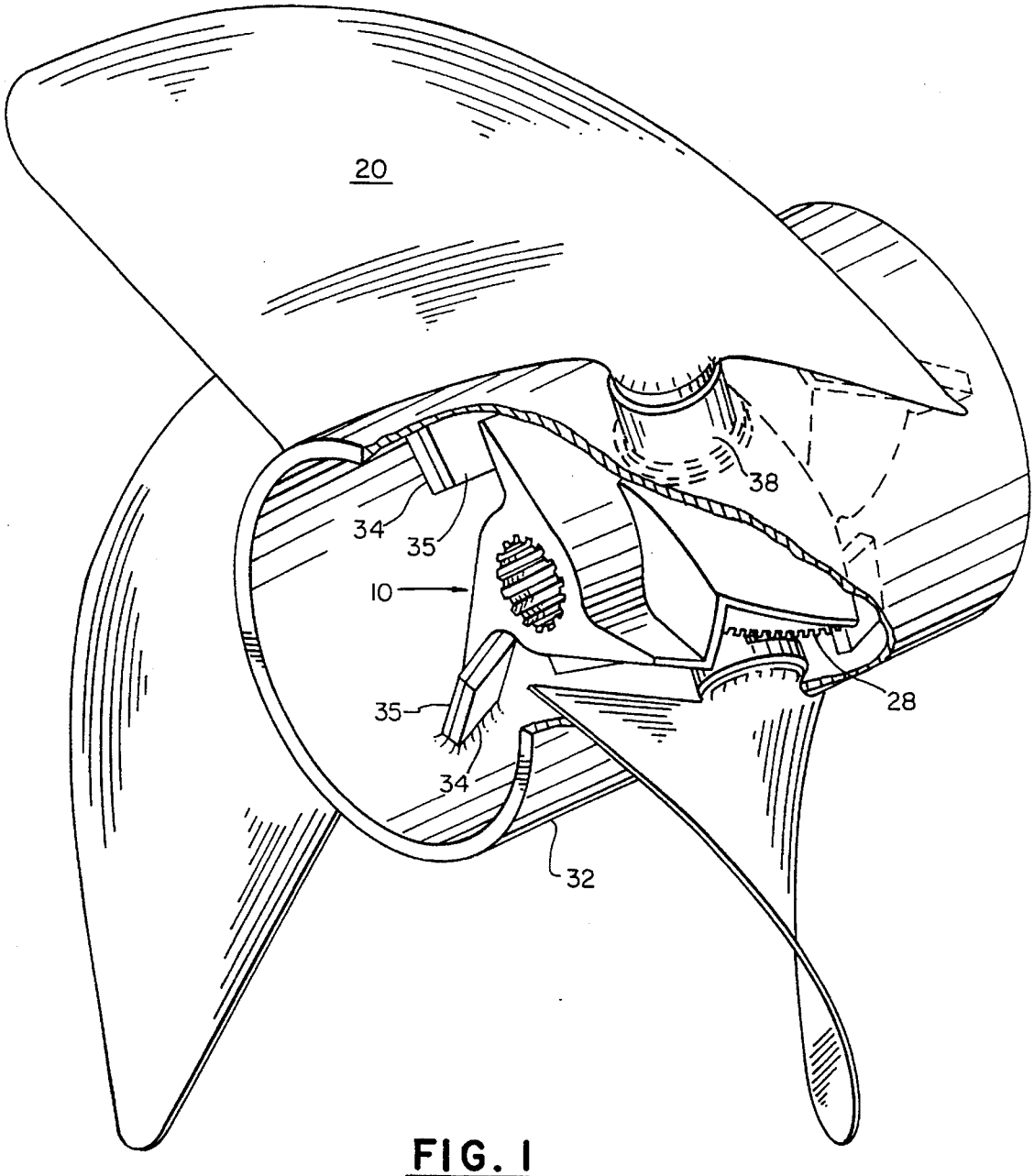
FIG. 1 is an isometric view of a prop embodying the invention, partially broken away to show internal details.
Figure 2:
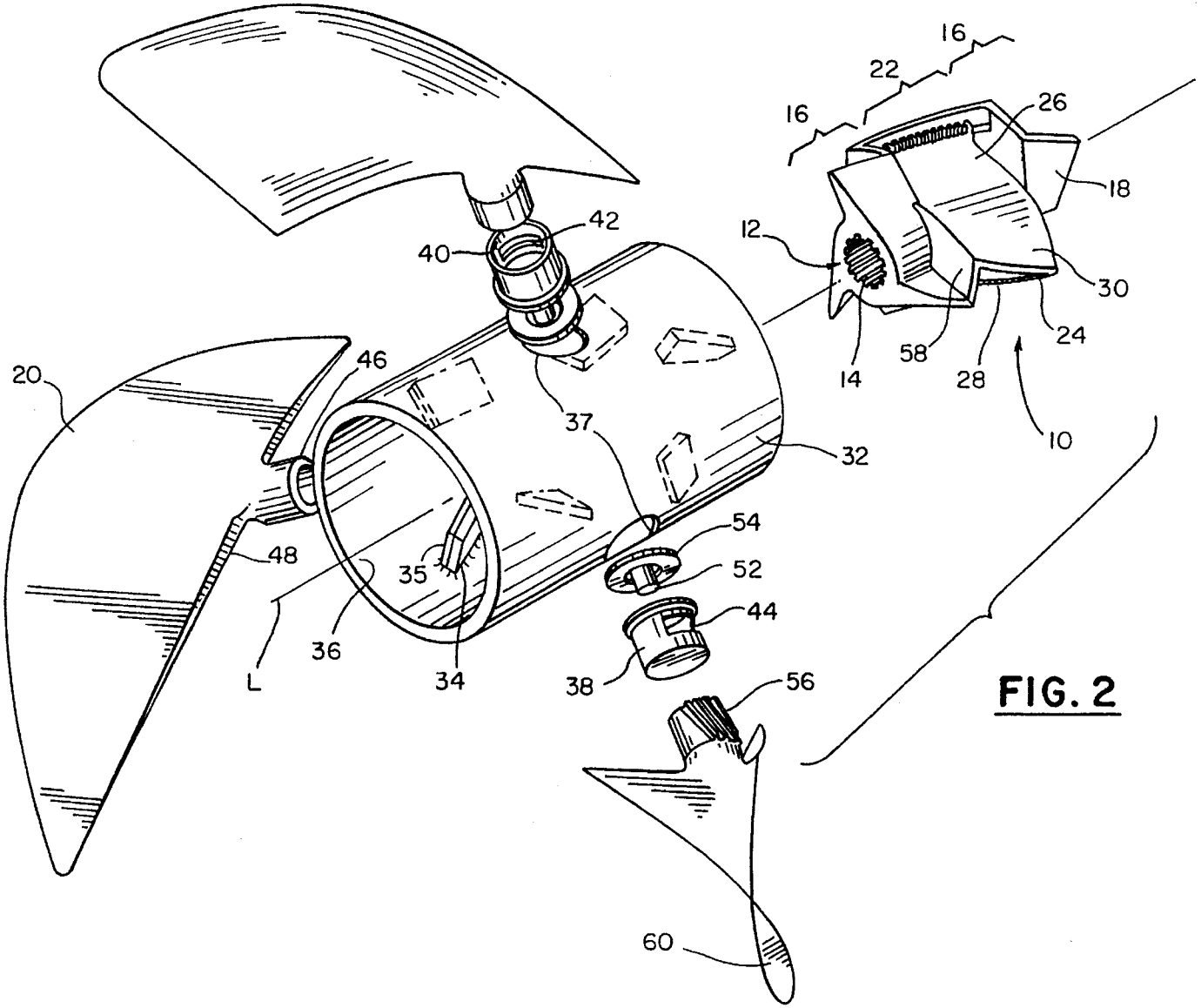
FIG. 2 is an exploded view corresponding to FIG. 1.

As shown in FIGS. 1–2, a variable pitch boat prop embodying the invention includes a hub 10 having a through bore 12 provided with internal splines 14 designed to mate with the splines on a prop shaft S which is driven by a motor, not shown. The splines might be replaced by a functional equivalent such as a key or polygonal shaft section. Alternatively, the hub could be welded to the shaft S, or formed integrally with it. When assembled, the hub and the shaft have a common longitudinal axis L.

The hub is longitudinally symmetrical. At either end of the hub, there is a multi-fluted portion 16, the number of flutes 18 corresponding to the number of blades (three are illustrated for the preferred embodiment). The flutes have a steep helix angle-well above 60°. The optimum angle depends on the shape and size of the blades 20, the engine characteristics and gear reduction ratio, and the drag of the boat. The exact value of the helix angle may be determine empirically, in conjunction with the best value for the center of pressure offset distances, as defined below.

The center portion 22 of the hub has three crests 24 which face radially outward, separated by three troughs 26. A rack-like gear segment 28 is affixed to or formed integrally with the leading edge of each crest, along a helical path running along the trailing faces 30 of the flutes at either end of the hub. The reason for this alignment will become apparent.

The gear segments 28 function like straight racks, but they are slightly twisted, since the pitch line of each is helical, rather than linear. Since they are not true linear racks, we refer to them herein as "rack-like gear segments" for accuracy.

Now, coaxially surrounding the hub is a strong metal sleeve 32 whose inner diameter is slightly greater than the maximum diameter of the hub, so that the sleeve can move lengthwise with respect to the hub. Three pairs of low-friction polymeric pads 34 made, for example, from teflon or nylon, are affixed to protuberances 35 cast on the inside surface 36 of the sleeve. Each pair of these protuberances is situated astride a respective one of three equally spaced holes 37 in the sleeves and each pad has a bearing surface substantially aligned with one of the helical paths described above. The pads provide sliding abutments for the respective flutes and are normally not loaded; they transfer torque from the hub to the prop only in reverse.

The three prop blades 20 are supported on the sleeve by bearing assemblies, each comprising a shell 40 pressed or welded into a respective one of the holes 37, and a hat-shaped bushing 42 of a low-friction material pressed or otherwise secured in the shell. The axes of the bearings intersect the prop shaft axis, but they are inclined rearwardly (i.e., away from the boat) with respect to that axis, at a rake angle of about 20° to 30°.

Figure 3:
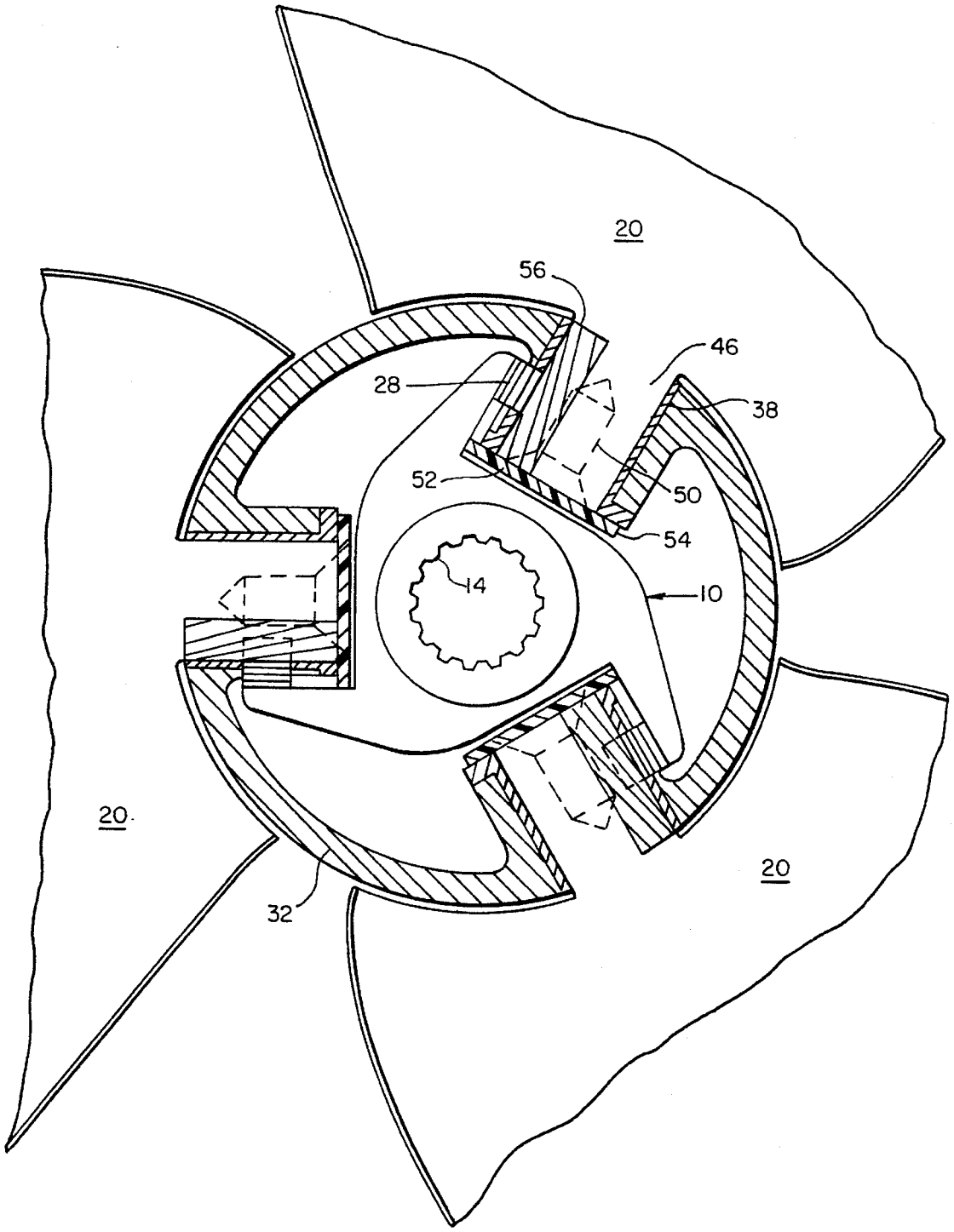
FIG. 3 is a sectional view taken on a plane containing the axis of the stub shaft of one blade, viewed along the axis of the prop.

The "brim" of each hat-shaped bushing acts as a thrust bearing to withstand the centrifugal force of the blades. The bushings receive stub shafts 46, each of which is welded to the radially inward edge 48 of one of the prop's blades 20. The inner end of the stub shaft has a threaded blind bore 50. A bolt 52, over which a washer 54 is placed, is threaded into the bore to retain the stub shaft in the bore, as shown in FIG. 3.

Pinion teeth 56 are formed over a portion of the circumference of the stub shaft, facing the rack. Their angular extent is sufficient to allow the blade to pivot between about 15° and 30°, or whatever range is deemed necessary. Both the shells and the bushings have lateral windows 44 facing their respective racks; the windows permit the racks and pinions to mesh. The helical pitch line of the rack passes through the window opening. Since the rack teeth extend widthwise along radii of the hub, and the stub shafts are inclined about 20° from the radial direction, the pinion teeth are formed with a corresponding helix angle so as to mesh properly with the rack-like gear segments.

Figure 4:
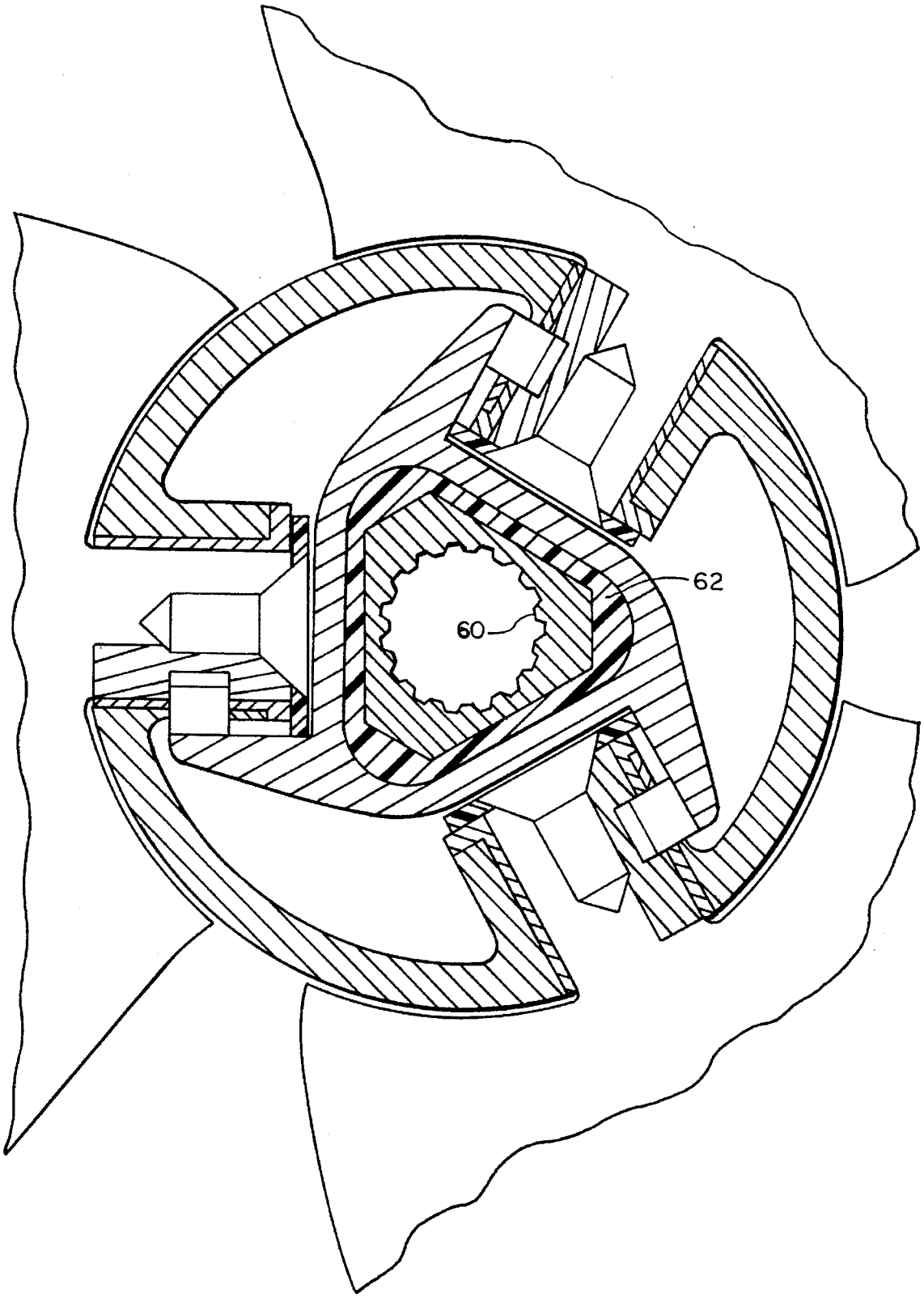
FIG. 4 shows a modified form of the hub.

FIG. 4 shows a modification wherein the hub is hollow and contains a polygonal core 60 surrounded by a rubber damper 62.

To use the invention, the hub of the prop is slipped onto the prop shaft, and secured in position by a nut or the like, not shown. The boat is then operated normally, no attention to the prop being necessary or possible during operation.

In operation, the opposed action of the each pad against the flutes, on the one hand, and the respective pinion against its rack segment, on the other, eliminates tangential free play, and since there are three such locations 120° apart, no net radial movement of the sleeve is possible. Thus, there need be no direct contact between the sleeve and the hub in order to keep them coaxial. The sleeve can move lengthwise with respect to the hub a short distance, limited by contact between ends of the protuberances 35 on the sleeve and the webs 58 formed on the hub at the interfaces between the end sections and the center section.

The blades themselves are unremarkable, except for the stub shafts affixed to them. Their clockwise-facing surfaces 60 are only slightly convex. But for the action of the pinions, the blades, being free to pivot, would tend to knife edge-wise through the water, producing no thrust. But with the pinion arrangement described above, a no-thrust attitude is unstable, and when the prop is turned in the water, the pitch increases until the pitch-increasing torque from the pinion is balanced by the pitch-reducing action of the dynamic pressure on the blade.

Since the invention is subject to modifications and variations, it is intended that the foregoing description and the accompanying drawings shall be interpreted as illustrative of only one form of the invention, whose scope is to be measured by the following claims.

I claim:

1. A variable pitch boat prop for connection to a prop shaft, said prop comprising a hub having means for connection to the shaft, a plurality of pivotable blades, each of said blades having a stub shaft extending toward the hub, a blade carrier disposed around the hub and independent of the hub having plural bearings for receiving said stub shafts, a plurality of pinions, one on each of said stub shafts, and a like plurality of rack-like gear segments fixed on said hub, each in constant mesh with a respective pinion, said rack-like segments following a pitch line having a helix angle greater than the maximum pitch angle of the blades.

2. The invention of claim 1, wherein the hub has, along its length, a central portion provided with plural crests to which said rack-like gear segments are affixed, and two end portions, each having plural flutes substantially aligned with respective ones of said segments, and wherein the blade carrier is a sleeve surrounding the hub and having an inner surface with plural protuberances thereon for abutting each of said flutes, to stabilize the sleeve and transfer torque during reverse operation.

3. The invention of claim 2, further comprising means for limiting axial movement of the sleeve with respect to the hub, so as to correspondingly restrict the blade pitch angle to a range of useful angles.

4. The invention of claim 3, wherein said angle is less than about 30°.

5. The invention of claim 3, wherein said movement limiting means comprises webs formed on the center section of the hub, for engaging the inner ends of either of said protuberances.

6. The invention of claim 1, wherein said helix angle of the racks is at least 60°.

7. The invention of claim 1, wherein each of said stub shafts has an axis which intersects the hub axis at a non-perpendicular angle such that each blade extends obliquely rearward with respect to the hub.

8. The invention of claim 7, wherein said non-perpendicular angle is about 20° to 30°.

9. The invention of claim 1, wherein said plurality of blades is at least three.

* * * * *